United States Patent [19]

Kessler

[11] 4,117,946

[45] Oct. 3, 1978

[54] PLASTIC CAP FOR WIDEMOUTHED CONTAINERS

[76] Inventor: Milton Kessler, 6690 Harrington Ave., Youngstown, Ohio 44512

[21] Appl. No.: 742,128

[22] Filed: Nov. 15, 1976

[51] Int. Cl.[2] ..... B65D 41/18

[52] U.S. Cl. ..... 215/321; 150/0.5; 215/10

[58] Field of Search ..... 150/0.5; 215/321, 10

[56] References Cited

U.S. PATENT DOCUMENTS

| | | | |
|---|---|---|---|
| 2,663,450 | 12/1953 | Bourcart | 215/10 |
| 3,471,052 | 10/1969 | Atkins | 215/321 |
| 3,825,144 | 7/1974 | Wiedmer | 215/321 |
| 3,828,962 | 8/1974 | Atkins | 215/321 |
| 3,843,016 | 10/1974 | Bornhorst | 215/321 |

FOREIGN PATENT DOCUMENTS

| | | | |
|---|---|---|---|
| 148,150 | 9/1952 | Australia | 215/321 |
| 961,801 | 1/1975 | Canada. | |
| 1,440,756 | 4/1965 | France | 215/321 |
| 1,174,984 | 3/1959 | France | 215/321 |
| 559,673 | 3/1975 | Switzerland | 215/321 |
| 963,957 | 7/1964 | United Kingdom | 215/321 |

*Primary Examiner*—Ro E. Hart
*Attorney, Agent, or Firm*—David A. Burge Co.

[57] ABSTRACT

A plastic cap has a closure wall positionable across a container neck opening, and an integrally formed skirt wall adapted to extend around the container neck. Projections are formed on the inner surface of the skirt wall and extend laterally of the skirt toward the neck. Elongated lug-like formations depend from the closure wall into the neck opening and bias portions of the container neck toward the skirt-carried projections to clamp neck portions against the projections, whereby the cap is securely releasably retained on the container neck. In preferred practice, the skirt-carried projections cooperate with neck-carried protrusions to provide snap-on, snap-off actions as the cap is pressed onto and removed from the container neck. Another preferred feature is the use of a specially configured upstanding formation on the top surface of the closure wall which not only facilitates nesting the container cap with a similarly configured recess formed in the bottom wall of the container, but also serves to maintain alignment between the labeled fronts of stacked, displayed containers.

32 Claims, 6 Drawing Figures

PLASTIC CAP FOR WIDEMOUTHED CONTAINERS

BACKGROUND OF THE INVENTION

1. Field of the Invention

The present invention relates to plastic caps for closing container neck openings, and has particularly advantageous use with widemouthed plastic containers of the type commonly used to dispense small quantities of such viscous substances as ointments and the like.

2. Prior Art

Widemouthed plastic containers are used extensively to dispense small quantities of viscous substances such as petroleum jelly, cosmetics, creams, ointments and the like. The containers are usually substantially rectangular, when viewed in horizontal cross-section, and provide an elongated neck opening bounded by two relatively long side walls and two relatively short side walls. The long side walls are frequently slightly curved to increase the central width of the neck opening. One or both pairs of side walls are commonly provided with laterally extending protrusions on their outer surface to assist in retaining a cap on the container neck.

Proposals to provide containers of this type with inexpensive snap-on, snap-off caps have presented a number of drawbacks. A problem common to all known prior proposals is the tendency of their caps to dislodge relatively easily, whereby the contents of the container are exposed if the container is jossled about or dropped. This problem is particularly annoying when container caps dislodge while the containers are being transported in one's luggage.

An approach common to most previous proposals is the use of a stamped metal cap having skirt-wall projections which extend toward and are intended to cooperate with neck-carried protrusions to hold the cap in place on a container neck. While the resulting cap structure is quite rigid and tends to tightly clamp portions of the container neck, the problem remains that the neck portions are relatively flexible and tend to deflect inwardly when the container is jossled about or dropped, thereby releasing the clamping action of the container cap and permitting it to dislodge.

A problem with the use of stamped metal caps is that they are relatively expensive to fabricate. As a safety precaution, the bottom rim of their skirt walls is usually rolled over to shield sharp edge surfaces, and this rolling step adds to the cost of the cap. The skirt-carried cap-retaining projections are usually formed by stamping depressions into opposite side walls of the skirt, and this operation also adds to the cost of the cap.

Still another drawback of stamped metal caps for widemouthed containers is that the depressions formed in opposite side walls detract from the appearance of the cap. These required depressions taken together with the need for a rolled rim at the base of the cap foreclose the possibility of providing a cap which has smooth outer walls and a clean, crisp appearance. Difficulties encountered in getting skirt-carried depressions and projections to function properly in retaining stamped metal caps on widemouthed containers has, in fact, lead to the use of very wide, long depressions and projections, which detract very noticeably from the appearance of the caps.

A further problem with previously proposed cap retaining systems for use with widemouthed containers is that their mechanisms tend to lessen in effectiveness with repeated use. This tendency toward diminished effectiveness is frequently coupled with a further diminution in cap-retaining capability caused by the lubricating action of the contents of the container forming a film coating the cap retaining projections and protrusions. As a result, it is not at all unusual to find the snap-cap containers of experienced travelers thoroughly taped to prevent their caps from dislodging during transit.

Still another problem encountered with previously proposed cap constructions for widemouthed containers is that they do little if anything to facilitate the nested stacking of a plurality of containers on drug store shelves and the like. To the extent that proposed cap constructions do attempt to facilitate stacking of containers, they do little if anything to maintain an aligned arrangement of the fronts of the containers so that container labels remain aligned to form an attractive display. If a druggist makes a stacked display of the containers, as he must to conserve valuable shelf space, he finds that proposed containers slide easily atop each other and assume unaligned positions which not only detract from the appearance of the display but also frequently contribute to displayed containers being upset or dropped by customers. This not only results in container damage, but also frequently causes the container caps to dislodge, thereby exposing container contents.

SUMMARY OF THE INVENTION

The present invention overcomes the foregoing and other drawbacks of previous proposals by providing a novel and improved plastic cap which is particularly well adapted for use with widemouthed containers.

A significant feature of container caps embodying the preferred practice of the present invention is that they are securely releasably retained on their containers and will remain in place despite normal jossling and dropping. The novel cap retention system works well, even with relatively thin, flexible container neck walls. Moreover, the novel cap retention system continues to perform well through repeated use, and its operation is not disturbed by the presence of a film of container contents.

Another significant feature is the provision of a cap retention system which can be used with a wide variety of existing container constructions, and which does not require unsightly indentations or depressions and the like on outer surfaces of the cap. Caps incorporating the preferred practice of the present invention can, and preferably do, have a clean, uncluttered outer appearance which can be designed to conform pleasingly to the shape of their associated containers.

A further feature of caps embodying the preferred practice of the present invention lies in their provision of a raised top surface formation to facilitate nesting of capped containers one atop the other. The raised top surface formation preferably takes the form of an endless, non-circular, loop-like rib which is formed integrally with the closure wall of the cap, which is spaced inwardly from the skirt wall and conforms to the shape of the container and its cap, and which is adapted to register with a correspondingly non-circular shaped recess formed in the bottom wall of the container. This feature permits sizeable displays of stacked, nested containers to be displayed in a limited amount of shelf space without concern that the containers will easily shift, upset, or spill. Moreover, when the non-circular ribs and recesses of stacked containers are in registry, they function to maintain alignment of the container fronts so that the container labels are aligned and present an attractive display.

Turning now, more particularly, to a description of the preferred cap embodiment using terms which appear in the appended claims, a plastic cap of preferred construction includes a closure wall which is adapted to be positioned across a container neck opening. The cap is provided with inner and outer formation means which depend from the closure wall alongside inner and outer surface portions of the container neck. The inner formation means preferably takes the form of a plurality of elongated, lug-like formations which depend into the neck of the container and engage inner surface portions of the neck. The outer formation means preferably takes the form of a skirt wall which extends around the outer surface of the neck.

Continuing the description using terms from the appended claims, laterally extending projection means are formed integrally with and are carried by at least one of the inner and outer formation means. Such projection means preferably comprise elongated projections formed on the inner surface of the skirt wall. At least one of the inner and outer formation means is configured to engage the container neck and to bias portions of the neck into firm engagement with the projection means. This feature preferably takes the form of the previously mentioned lugs which project into the container neck, which engage inner surface portions of the neck, and which bias neck portions toward the skirt-carried projections to clamp neck portions against the projections.

Having briefly described the elements of the preferred embodiment, it is important to understand how they cooperate to provide an improved cap retention system. As was pointed out previously, a problem in designing cap retention systems for use with widemouthed plastic containers is that the container walls are usually relatively flexible and can easily be deflected inwardly when jossled about or dropped. The present invention specifically addresses the problem of container wall flexure by providing a plurality of elongated, lug-like formations which extend inside the neck of the container, which engage inner surface portions of the neck, and which prevent these surface portions from deflecting inwardly. But more than that, the elongated, lug-like formations actually bias the flexible container walls outwardly toward and into firm clamping engagement with the skirt-carried projections. The approach taken by the present invention not only prevents container neck portions from deflecting inwardly and releasing their contact with the cap, but also actually deflects neck wall portions outwardly, changing, ever so slightly (but nonetheless significantly), the normal shape of the container neck to assure that a secure, positive engagement is made and retained between the neck and the cap.

The cap retention system of the present invention is found to be so effective that only very small cap-retaining projections need be formed on the inner surface of the cap's skirt wall. For example, a cap having a perimeter of 7 or 8 inches can be held in place quite adequately using two projections each about one quarter inch long and having a laterally extending thickness of only about 0.01 inch. Projections of this tiny magnitude can be molded easily on the inside surface of a cap without leaving corresponding, unattractive indentations on the outer surfaces of the cap.

Still another feature of the cap retention system of the present invention is that the small projections which are molded on inner cap surfaces can be located to cooperate with protrusions and other formations found on the necks of commercially available containers to provide a snap-on, snap-off cap locking action that is appealing to customers.

As will be apparent from the foregoing summary, it is one object of the present invention to provide a novel and improved plastic cap for containers.

It is a further object to provide, in combination, a widemouthed container with a novel and improved plastic cap.

These and other objects and a fuller understanding of the invention described and claimed in the present application may be mad by referring to the following description and claims taken in conjunction with the accompanying drawing.

DESCRIPTION OF THE PREFERRED EMBODIMENT

Figure 1:
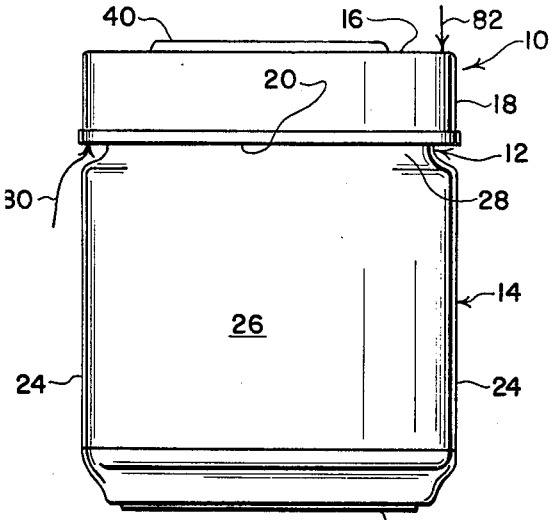
FIG. 1 is a side elevational view of a plastic cap embodying the preferred practice of the present invention and in place on the neck of a widemouthed container.

Referring to FIGS. 1–4, a plastic cap embodying the preferred practice of the present invention is indicated generally by the numeral 10. The cap 10 is shown in place on the neck 12 of a widemouthed container or plastic bottle 14. The cap 10 has a substantially planar top or closure wall 16 which extends across the neck opening of the container 12, and has an integrally formed, depending skirt wall 18 which extends around the outer surface of the container neck 12. An enlarged reinforcing rim 20 is formed at the bottom of the skirt wall 18.

The container or bottle 14 is of conventional configuration and is typical of a number of commercially available widemouthed plastic containers. The particular container 14 illustrated in the drawing is one used by Chesebrough-Pond's Inc. to dispense VASELINE brand petroleum jelly. The container 14 has a bottom wall 22, a pair of opposed upstanding end walls 24, a pair of opposed upstanding side walls 26, and integrally formed upstanding neck walls 28.

Figure 3:
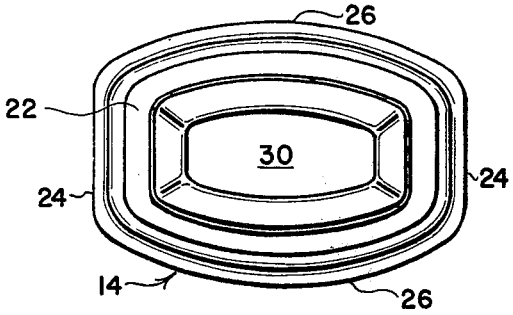
Figure 4:
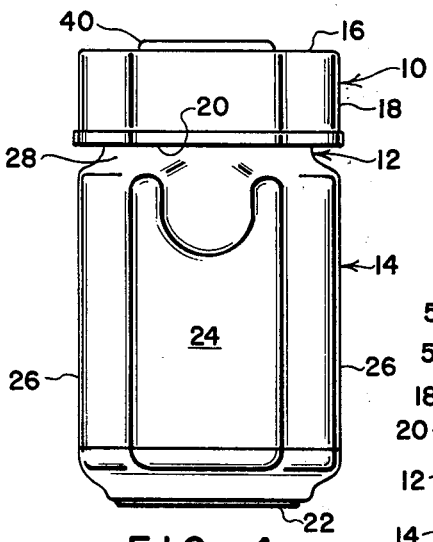
Figure 5:
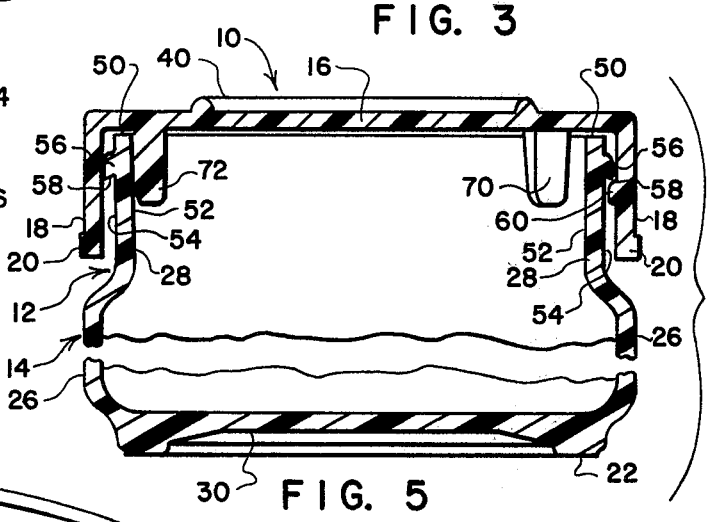
FIG. 5 is an enlarged, foreshortened, sectional view as seen from planes indicated by a broken line 5—5 in FIG. 2 with portions of the container removed; and, FIG. 6 is an enlarged perspective view of the cap of FIG. 1 with the cap being inverted to expose interior construction details and with a portion of the cap's skirt wall broken away.

As is best seen in FIGS. 3 and 5, a non-circular recess is formed in the bottom wall 20. The recess 30 is spaced substantially uniformly inwardly from the end and side walls 22, 24, and has a shape which corresponds to that of the container 12 when viewed in horizontal cross-section.

Figure 2:
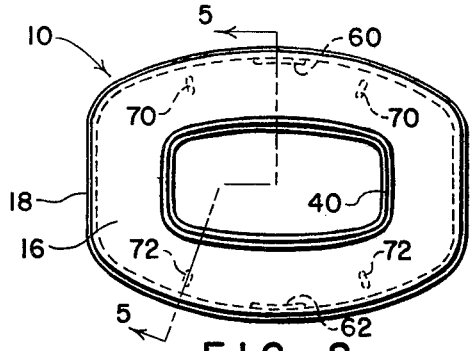
FIGS. 2, 3 and 4 are, respectively, top plan, bottom plane, and end elevational views of the cap and container of FIG. 1.

As is best seen in FIGS. 2 and 5, an upstanding, non-circular ring-like rib formation 40 is formed integrally with the closure wall 16 of the cap 10. The non-circular rib formation 40 is spaced substantially uniformly inwardly from the skirt wall 18 of the cap 10 and is configured to be received in the non-circular recess 30 to facilitate nested vertical stacking of a plurality of the containers 12 each bearing one of the caps 10. When the non-circular ribs and recesses 40, 30 of a plurality of stacked containers are nested, the fronts of the containers are maintained in alignement as are any labels carried on the container fronts. The rib and recess formations 40, 30 preferably have the substantially elliptical shape shown in the drawing.

Referring to FIG. 5, the container neck walls 26 have an upper end or rim 50 which defines a container neck opening. The neck walls 26 have inner surfaces 52 and outer surfaces 54. A ring-like protrusion 56 is formed integrally with the neck walls 26 and extends perimetrically around the outer surfaces 54 at a location spaced slightly downwardly from the rim 50. A relatively sharp edge 58 is formed on the lower surface of the protrusion 56.

Figure 6:
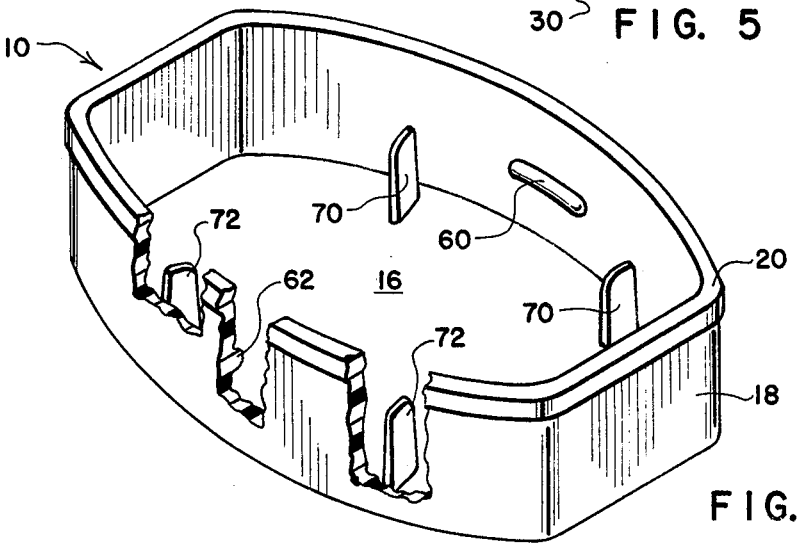

Referring to FIGS. 5 and 6, a pair of elongated, opposed, laterally inwardly extending projections 60, 62 are formed on the inner surface of the skirt wall 18. While the size of the projections 60, 62 should be determined in accordance with such variables as amount of force one wants to require to install and remove the cap 10 from the neck of the container 12, an important observation to make that, in most instances, the projections 60, 62 can be quite small in size as compared with other dimensions of the cap 10. A cap having a perimeter of 7 to 8 inches, for instance, can be held securely in place with two projections each being about one quarter inch in length and having a thickness of about 0.01 inch. A further observation which should be made regarding the size of the projections 60, 62 is that they are so small that no corresponding depressions or dimples need appear on the outer surface of the skirt wall 18 opposite the proejctions 60, 62 whereby a skirt wall 18 having a clean, unbroken outer appearance is provided.

The projections 60, 62 are preferably located in a common plane which parallels both the plane of the closure wall 16 and the plane of the rim 50, and which is located about midway between the planes of the closure wall 16 and the rim 50. The number of projections 60, 62 which are used on the cap 10 and the dimensions of the projections 60, 62 are determined in accordance with the amount of force one wants to require to effect cap installation and removal. The projection arrangement shown in the drawing is the preferred one and has been found to give particularly good results where the projections 60, 62 are associated with the longer pair of the four upstanding neck walls 26.

Two pairs of elongated, lug-like formations 70, 72 are formed integrally with the closure wall 16, and extend into the container neck 12. One of the pairs 70 is associated with one of the projections 60, and the other of the pairs 72 is associated with the other of the projections 62. Each of the formations 70, 72 is substantially rectangular when viewed in cross-section, and tapers slightly, diminishing in cross-sectional area as it extends away from the closure wall 16. As is best seen in FIG. 2, the formations 70, 72 are oriented in directions which substantially orthogonally intersect the nearest portion of the skirt wall 18.

The formations 70, 72 join the closure wall 16 at locations spaced from the skirt wall 18. The formations 70 are located along the skirt wall 18 on opposite sides of the projection 60, and the formations 72 are located along the skift wall 18 on opposite sides of the projection 62. Each of the formations 70, 72 has a length which causes its lower end to depend farther away from the closure wall than is its associated projections 60, 62. Stated in another way, the lug-like formations are preferably longer than the distance between the projections 60, 62 and the closure wall 16, but are preferably shorter than the height of the skirt wall 18.

While the size and number of elongated lug-like formations 70, 72 used on a particular cap is a matter of design choice, the preferred arrangement is illustrated in the drawing and includes the use of a separate pair of formations 70, 72 with each of the projections 60, 62. Moreover, the formations 70, 72 and the projections 60, 61 are preferably associated with a relatively lengthy container neck wall portion which can be resiliently deflected into tight clamping engagement with the projections 60, 62.

In operation, as the cap 10 is being pressed onto the container 14, the tapered formations 70, 72 engage the inner surfaces 52 of the neck walls 26 and bias neck wall portions outwardly into firm engagement with the projections 60, 62. The tapered nature of the formations 70, 72 cause neck wall portions to be deflected outwardly to progressively greater degrees as the cap 10 is pressed farther onto the container neck 12, thereby assuring strong, intimate clamping engagement between the outer surfaces 54 of the neck 12 and the projections 60, 62. The progressive and positive clamping action used by this cap retention system is found to function properly after many repeated uses and even in the presence of films of container contents on the various components of the cap retention system.

In preferred practice, the projections 60, 62 are located and configured to cooperate with such laterally extending protrusion as may be formed on the neck of the container to be capped. In the instant example, the projections 60, 62 are located and configured to cooperate with the container neck protrusion 56. When the cap 10 is pressed into place on the container neck 12, the projections 60, 62 engage and are forced over the protrusion 56. This gives a desirable snap-on action to the cap installation procedure. When the cap 10 is in place on the neck 12, the projections 60, 62 adjacently underlie the protrusion 56 and help retain the cap in place on the container 14. Whrn the cap 10 is in place on the container 14, the sharp edge 58 of the protrusion 56 directly engages the projections 60, 62. When the cap 10 is removed from the container neck 12, the projections 60, 62 must be forced back over the protrusion 56, giving a desirable snap-off action to the cap removal procedure.

A preferred method of removing the cap 10 from the container neck 12 is to insert one's thumb unber one end of the cap's rim 20, as indicated by an arrow 80 in FIG. 1 while simultaneously depressing the other end of the cap 10 with one's finger, as indicated by an arrow 82 in FIG. 1. This technique keeps skirt wall portions of the cap which carry the projections 60, 62 from deflecting inwardly during cap removal, and in fact, tends to bulge these skirt wall portions slightly outwardly, facilitating passage of the projections 60, 62 over the neck protrusion 56.

As will be apparent from the foregoing description, the present invention provides a novel and improved plastic cap for containers. While the description of the preferred embodiment has utilized, for purposed of an example, a widemouthed bottle application, it will be appreciated that the present invention has applications on many types of containers having relatively large neck openings, particularly where the flexibility of neck wall material renders difficult the retention of a cap thereon.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A plastic cap for closing a container neck opening, comprising:

(a) a closure wall adapted to be positioned across a container neck opening;

(b) inner and outer formation means formed integrally with the closure wall and projecting from spaced portions thereof for respectively overlying inner and outer surface portions of the container neck when the cap is in place on the container neck with the closure wall positioned across the container neck opening;

(c) one of the inner and outer formation means having laterally extending projection means formed integrally therewith and projecting toward a selected container neck portion when the cap is in place on the container neck with the closure wall positioned across the container neck opening; and, (d) the other of the inner and outer formations means including a plurality of individual formations configured to engage the container neck at distinct spaced locations around the periphery of the container neck opening and to bias the selected container neck portion toward and into firm engagement with the projection means when the cap is in place on the container neck with the closure wall positioned across the container neck opening, whereby the engagement established between the projection means and the selected container neck portion assists in firmly releasably retaining the cap on the container neck.

2. The plastic cap of claim 1 wherein the selected container neck portion includes a curved wall formed from a relatively stiff but resiliently bendable material which tends to retain a given curvature when the cap is not in place on the container neck, and wherein:

(a) the projection means is operable to engage one side of the curved wall when the cap is in place on the container neck with the closure wall positioned across the container neck opening; and, (b) the individual formations are operable to engage the other side of the curved wall and to alter the given curvature of the curved wall in biasing the curved wall into engagement with the projection means when the cap is in place on the container neck with the closure wall positioned across the container neck.

3. The plastic cap of claim 2 wherein the one side of the curved wall is convexly curved, the other side of the curved wall is concavely curved, and the individual formations are operable to increase the curvature of the curved wall in biasing the curved wall into engagement with the projection means.

4. The plastic cap of claim 3 wherein the individual formations include a pair of formations each being operable to engage the curved wall at a separate location spaced peripherally around the container neck opening from the projection means.

5. The plastic cap of claim 4 wherein the outer formation means includes a skirt wall which extends perimetrically around and is formed integrally with the closure wall, and the projection means includes at leat one projection formed on the inner surface of the skirt wall.

6. The plastic cap of claim 5 wherein the skirt wall extends away from the closure wall of and defines a rim spaced from the closure wall, and the projection is located at a substantial distance from the rim.

7. The plastic cap of claim 6 wherein the projection is of elongated configuration and extends in a plane which parallels the plane of the closure wall, the plane of the projection being located about midway between the rim and the plane of the closure wall.

8. The plastic cap of claim 5 wherein an outer surface portion of the skirt wall which overlies the projection is smooth and gives no visual indication of the fact that a projection is formed on the inner surface of the skirt wall.

9. The plastic cap of claim 5 wherein the individual formations are elongate and extend away from the wall in directions substantially paralleling inner surface portions of the skirt wall.

10. The plastic cap of claim 9 wherein the elongate individual formations have ends which lie in a substantially common plane located between a plane of the closure wall and a plane of the rim.

11. The plastic cap of claim 10 wherein the projection extends in a plane located between the common plane and the plane of the closure wall.

12. The plastic cap of claim 10 wherein the elongate individual formations are substantially rectangular when viewed in cross-section and taper slightly, diminishing in cross-sectional area as they extend away from the closure wall.

13. The plastic cap of claim 12 wherein each of the elongate individual formations is oriented such that, when viewed in cross-section, the longer dimebsion of its cross-section extends in a direction which intersects a nearbly portion of the skirt wall substantially orthogonally.

14. The plastic cap of claim 1 wherein at least one laterally extending protrusion is carried on the selected container neck portion, and the laterally extending projection means formed on the cap cooperates with the laterally extending protrusion to help releasably retain the cap in place on the container neck with the closure wall positioned across the container neck opening.

15. The plastic cap of claim 14 wherein the laterally extending projection means is arranged such that it must engage and pass over the laterally extending protrusion as the cap is pressed onto and removed from the neck of the container, whereby the laterally extending projection means serves not only to frictionally clamp the cap in place on the container neck but also cooperates with the laterally extending protrusion to give a snap-on, snap-off action as the cap is pressed onto and removed from the neck of the container.

16. The plastic cap of claim 1 additionally including an upstanding formation formed integrally with the closure wall and adapted to be received in a recess formed in a bottom wall of another container to facilitate nested stacking of a container carrying the described cap with such another container.

17. The plastic cap of claim 16 wherein the upstanding formation is a bead of plastic forming an endless loop having a shape which is similar to the shape of the perimeter of the closure wall.

18. The plastic cap of claim 16 wherein the upstanding formation is non-circular in shape and is operable when nested in the bottom wall recess to maintain alignment between the selected skirt wall portions of the cap and selected side wall portions of the container.

19. In combination, a container having a neck and a plastic cap for closuing an opening formed at an end of the container neck, wherein:

(a) the cap has a closure wall adapted to be positioned across the container neck opening;

(b) the cap has inner and outer formation means formed integrally with the closure wall and projecting from spaced portions thereof for respectively overlying inner and outer surface portions of the container neck when the cap is in place on the container neck;

(c) one of the inner and outer formation means has laterally extending projection means formed integrally therewith and projecting toward an associated neck portion when the cap is in place on the container neck;

(d) the container neck is formed from a relatively stiff but resiliently bendable material which tends to retain a given configuration when the cap is not in place on the container neck; and, (e) the other of inner and outer formation means includes a plurality of individual formations configures to engage the container neck at distinct spaced locations around the periphery of the container neck opening and to bias the associated container neck portion into firm engagement with the projection means, whereby the given configuration of the container neck is at least slightly altered by the biasing action of the individual formations to assist in securely, releasably retaining the cap on the container neck.

20. The combination of claim 19 wherein the associated container neck portion includes a curved wall the normal curvature of which is increased by the biasing action of the individual formations when the cap is in place on the container neck.

21. The combination of claim 20 wherein the individual formations include a pair of formations each being operable to engage the curved wall at a separate location spaced peripherally around the container neck opening from the projection means.

22. The combination of claim 19 wherein at least one laterally extending protrusion is carried on the container neck, and the laterally extending projection means formed on the cap cooperates with the laterally extending protrusion to help releasably retain the cap in place on the container neck with the closure wall positioned across the container neck opening.

23. The combination of claim 22 wherein the laterally extending projection means is arranged such that it must engage and pass over the laterally extending protrusion as the cap is pressed onto and removed from the neck of the container, whereby the laterally extending projections means serves not only to frictionally clamp the cap in place on the container neck but also cooperates with the laterally extending protrusion to give a snap-on, snap-off action as the cap is pressed onto and removed from the neck of the container.

24. The combination of claim 19 wherein the container includes a bottom wall having a non-circular recess formed therein, and a non-circular, upstanding formation is formed integrally with the closure wall of the cap, the non-circular, upstanding formation being configured to be received in the non-circular recess whereby, when the cap is removed from the container, the container can be supported atop the cap with the formation nested in the recess, and selected portions of the skirt wall of the cap will be maintained in alignment with selected side wall portions of the container.

25. The combination of claim 24 wherein both the non-circular recess and the non-circular formation are substantially elliptical in configuration.

26. The combination of claim 24 wherein:

(a) the container has an outer wall with a given cross-sectional configuration;

(b) the container neck has a cross-sectional configuration which is dimensionally smaller than but similar in shape to that of the outer wall;

(c) the cap has a skirt wall with a cross-sectional configuration and size substantially the same as that of the outer wall of the container;

(d) the bottom wall recss has a configuration which is dimensionally smaller than but similar in shape to that of the outer wall; and, (e) the upstanding formation has a configuration which is dimensionally smaller than but similar in shape to that of the bottom wall recess.

27. A plastic cap for use with a container of the type having a neck whidh defines an opening at one end of the neck and which has a cap-retaining protrusion formed on the outer surface of the neck, the cap comprising:

(a) a closure wall adapted to be positioned across the container neck opening;

(b) a skirt wall formed integrally with the closure wall and having an inner surface adapted to extend alongside the outer surface of the neck when the closure wall is positioned across the container neck opening;

(c) laterally extending projection means formed integrally with the shirt wall on the inner surface thereof and projecting toward the outer surface of the neck;

(d) the projection means being configured such that when the cap is pressed onto and removed from the container neck, the projection means forcibly engages and passes over the protrusion, and being located such that when the cap is in place on the container neck with the closure wall positioned across the container neck opening, the projection means engages the protrusion to securely retain the cap on the container neck; and, (e) formation means including a plurality of individual formations formed integrally with the closure wall and depending therefrom into engagement with inner surface portions of the neck at locations spaced peripherally around the neck opening when the cap is in place on the neck to bias portions of the neck toward the skirt wall of the cap to assist in securely releasably retaining the cap on the container.

28. The plastic cap of claim 27 wherein the individual formations are located such that the neck portions which are biased toward the skirt wall of the cap are such neck portions as carry at least a portion of the protrusion.

29. The plastic cap of claim 28 wherein:

(a) the projection means include a pair of opposed elongated projections formed on the inner surface of the skirt wall; and, (b) the individual formations include two pairs of elongated formations with each pair being associated with a separate one of the elongated projections.

30. The plastic cap of claim 27 wherein the container neck is formed from relatively stiff but bendable material which assumes a given normal configuration in the absence of the cap, and the individual formations are operable to at least slightly alter the given normal configuration of the neck as they bias portions of the neck toward the outer wall of the cap.

31. A plastic cap for use with a container of the type which has a non-circular recess formed in its bottom wall, the cap having a closure wall adapted to close a noncircular neck opening formed on the container and having a skirt wall with certain portions thereof which are aligned with selected portions of the container's side walls when the cap is in place on the container, the cap having formation means formed integrally with the closure wall and projecting upwardly therefrom, the formation means being non-circular and having a configuration adapted to nest within the non-circular recess, whereby, when a plurality of capped containers of the described type are stacked one atop another with the formation means of one capped container nested in the recess of an aligned container, the certain and selected wall portions are held in alignment by the nesting of the formation means and the recess.

32. The plastic cap of claim 31 wherein the formation means is an upstanding, substantially elliptically shaped rib.

* * * * *

UNITED STATES PATENT AND TRADEMARK OFFICE

CERTIFICATE OF CORRECTION

PATENT NO. : 4,117,946

DATED : October 3, 1978

INVENTOR(S) : Milton Kessler

It is certified that error appears in the above-identified patent and that said Letters Patent are hereby corrected as shown below:

Column 4, line 18, delete "mad" and substitute -- had --

Column 5, line 27, after "make" insert -- is --

Column 5, line 37, delete "proejctions" and substitute -- projections --

Column 5, line 68, delete "skift" and substitute -- skirt --

Column 6, line 14, delete "61" and substitute -- 62 --

Column 6, line 45, delete "Whrn" and substitute -- When --

Claim 6, line 2, delete "of"

Claim 9, line 2, after "the" insert -- closure --

Claim 13, line 3, delete "dimebsion" and substitute -- dimension --

Claim 13, line 5, delete "nearbly" and substitute -- nearby --

Claim 19, line 2, delete "closuing" and substitute -- closing --

Claim 19, line 23, delete "ures" and substitute -- ured --

Claim 26, line 10, delete "recss" and substitute -- recess --

UNITED STATES PATENT AND TRADEMARK OFFICE

CERTIFICATE OF CORRECTION

PATENT NO. : 4,117,946

DATED : October 3, 1978

INVENTOR(S) : Milton Kessler

It is certified that error appears in the above-identified patent and that said Letters Patent are hereby corrected as shown below:

Claim 27, line 2, delete "whidh" and substitute -- which --

Claim 27, line 14, delete "shirt" and substitute -- skirt --

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*